US011230461B2

(12) United States Patent
Inge

(10) Patent No.: US 11,230,461 B2
(45) Date of Patent: Jan. 25, 2022

(54) ROTATIONAL HOISTING DEVICE

(71) Applicant: Charles P Inge, Pelham, AL (US)

(72) Inventor: Charles P Inge, Pelham, AL (US)

( * ) Notice: Subject to any disclaimer, the term of this patent is extended or adjusted under 35 U.S.C. 154(b) by 80 days.

(21) Appl. No.: 16/894,790

(22) Filed: Jun. 6, 2020

(65) Prior Publication Data

US 2020/0385244 A1 Dec. 10, 2020

Related U.S. Application Data

(60) Provisional application No. 62/858,290, filed on Jun. 6, 2019.

(51) Int. Cl.
*B66C 23/20* (2006.01)
*B66D 3/04* (2006.01)

(52) U.S. Cl.
CPC ..... *B66C 23/203* (2013.01); *B66D 3/04* (2013.01); *B66D 2700/026* (2013.01)

(58) Field of Classification Search
CPC .... B66D 2700/026; B66D 3/04; B66C 23/203
See application file for complete search history.

(56) References Cited

U.S. PATENT DOCUMENTS 100,613 A * 3/1870 Fleming ..... B66C 23/36 212/204
1,015,236 A * 1/1912 Manross ..... B66D 3/04 254/409
5,617,963 A * 4/1997 Baziuk ..... B66C 23/208 212/179
7,174,995 B1 * 2/2007 Alexander ..... A01M 31/02 182/187
7,213,715 B2 * 5/2007 Boily ..... A62B 1/08 212/179
8,130,168 B1 * 3/2012 Sergi ..... H01Q 1/1242 343/882
9,345,941 B1 * 5/2016 Celedon ..... B66C 23/166
9,802,800 B2 * 10/2017 Kalakay, Jr. ..... B66D 3/26
10,252,895 B2 * 4/2019 Jordan ..... F24S 25/12
2011/0271608 A1 * 11/2011 Egan ..... F24S 30/422 52/122.1
2012/0227788 A1 * 9/2012 Lundahl ..... H02S 20/32 136/246
2017/0107736 A1 * 4/2017 Lockwood ..... B66C 23/207
2017/0247236 A1 * 8/2017 Svoboda ..... A62B 1/10
2018/0057334 A1 * 3/2018 Poczciwinski ..... B66C 23/44

* cited by examiner

*Primary Examiner* — Michael E Gallion
(74) *Attorney, Agent, or Firm* — Christopher R. Ganter, LLC

(57) ABSTRACT

The invention disclosed is a rotational hoisting device that is mounted into the top opening of a mast pole located on a cellular network tower. The hoisting device is connected to a third party block and tackle and hoist line that is connected to a piece of cellular network equipment such as an antenna or radio. The rotational hoisting device can rotate back and forth in the mast pole to achieve mounting of the cellular equipment on a particular position on the mast pole without ever having disconnect the cellular equipment from the hoist lie.

7 Claims, 4 Drawing Sheets

ROTATIONAL HOISTING DEVICE

CROSS-REFERENCED TO RELATED APPLICATIONS

This non-provisional patent application claims priority to Provisional Application No. 62/858,290 filed on Jun. 6, 2019 in its entirety.

FEDERALLY SPONSORED RESEARCH

None

SEQUENCE LISTING

None

FIELD OF THE INVENTION

The present invention relates to a cell phone tower radio and antenna hoisting device that provides safety to a worker as they haul pieces of equipment to the top of cell phone towers for installation.

BACKGROUND OF THE INVENTION

For many years, cellular telephone and network towers have been in existence. These towers are generally quite tall so as to project and broadcast cellular signals a further distance over various terrain than can be achieved at lower levels and ground level. The radios and antennas associated with these cell towers are often heavy and hauling heavy items up steep heights to the top of a tower presents safety concerns. One issue that confront cell phone tower installers is hauling a radio or antenna up to the top a tower by block and tackle and then having to manually detach a radio or antenna to install it at an appropriate position on a mast pole located at the top of the tower. Mast poles are vertical hollow poles that are mounted onto booms or steel beams. Antennas are then attached to the mast poles in a vertical orientation and multiple antennas are installed on multiple mast poles around the circumference of the cellular tower so that the antennas can be oriented to project in a desired direction on the circumference of the mast pole. Often times, the antennas are mounted on the rear or side of the mast poles and this requires the antenna to have to be detached from the hauling line to turn the antenna into the appropriate position. The step of detaching a radio or antenna from the tag line of a hoist line introduces a large measure of safety concern for both the installer and the safety of the equipment because the weight of the equipment can sometimes range in the 60-100 pound range and can be very precarious for an installer to pick up the equipment and locate it to an appropriate mounting position. Cellular towers have a gridwork of booms located at their topmost points. These booms support various equipment and mast poles that are purposed for mounting of antennas on the mast poles. These booms, or steel beams, are quite narrow and cause for very dangerous working conditions for installers. Carrying heavy equipment that has been hauled up to an appropriate mounting and/or installation location on the booms is very dangerous. What is needed in the art is a device and system whereby a piece of equipment such as an antenna or radio can be installed onto a mast pole without ever being detached from the hoist line such that an installer does not have to lift a heavy piece of equipment while it is unsecured.

SUMMARY OF THE INVENTION

The invention herein disclosed in is a rotational hoisting device used for hauling heavy cellular tower equipment such as radios and antennas to the top of a cellular tower. The hoisting device has a pole is comprised of a vertical rod having a defined upper portion and a defined bottom portion whereby they are separated by a collar that protrudes out from the rod. The hoist pole is further comprised of a head having a hollow cylindrical body portion and two vertical parallel plates that project of the outer surface of hollow cylindrical body portion. On the ends of the two vertical parallel plates are apertures that are adapted to receive a block and tackle and secured by a bolt through said apertures. The hoist pole functions by being inserted into the top end of a mast pole located on a cellular network tower. The block and tackle are connected to a winch located on the ground which hauls a cellular tower component such as an antennae or radio to the top of the tower via a hoist line. The collar of the hoist pole rests on the top edge of the mast pole and allows for rotation of the hoist pole such that an antenna does not have to be unhooked from the hoist line that hauled it up and can rotate the antenna such that it can be mounted on any side of the antenna without disengagement from the hoist line.

It should be understood that the present drawings are not necessarily to scale and that the embodiments disclosed herein are sometimes illustrated by fragmentary views. In certain instances, details which are not necessary for an understanding of the present invention or which render other details difficult to perceive may have been omitted. It should also be understood that the invention is not necessarily limited to the particular embodiments illustrated herein. Like numbers utilized though-out the various figures designate like or similar parts or structure.

DETAILED DESCRIPTION

Figure 1:
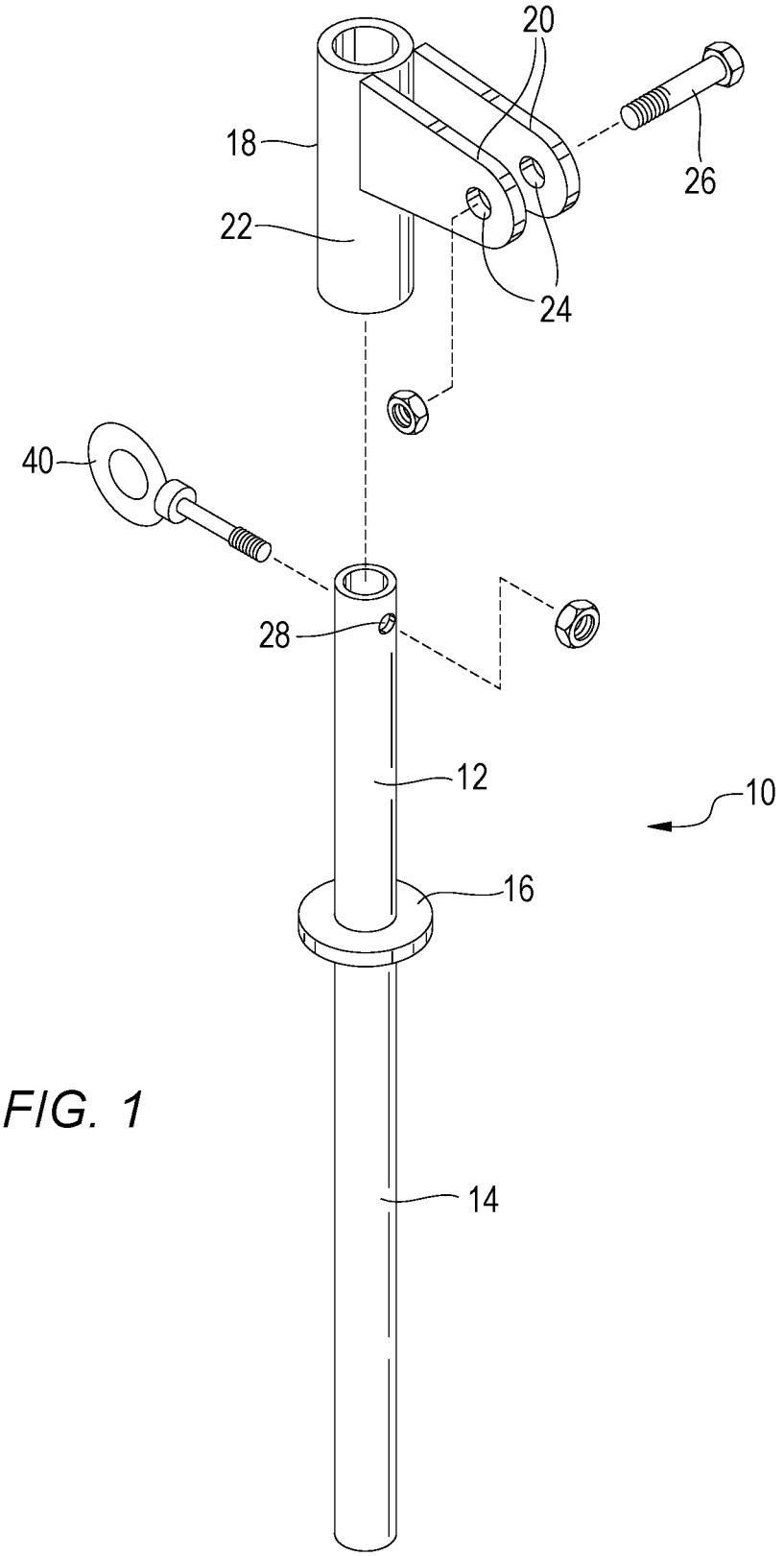
FIG. 1 is a perspective exploded view of the rotational hoisting device.
Figure 2:
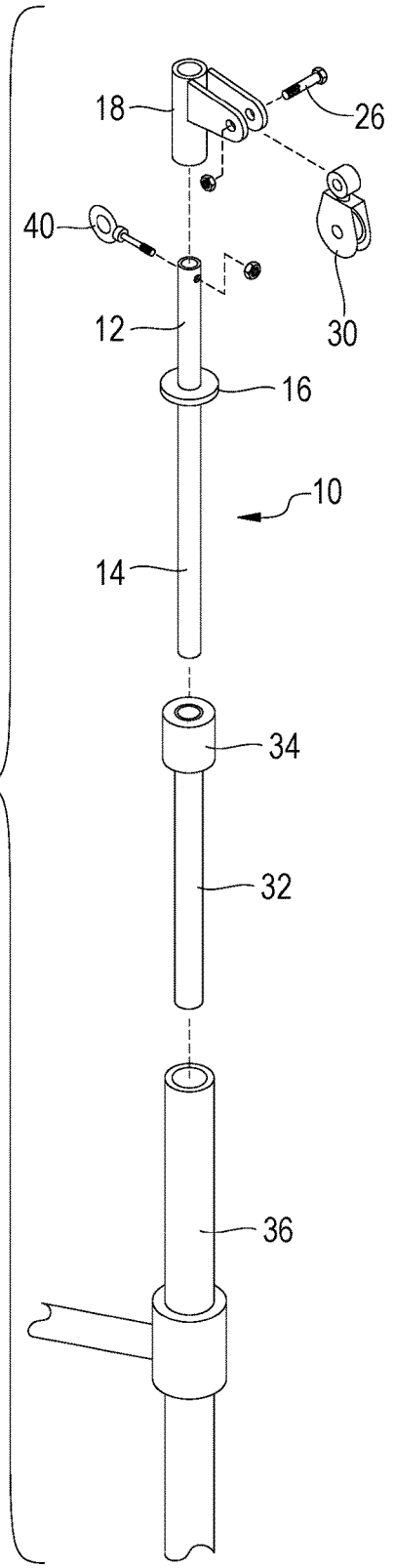
FIG. 2 is an exploded perspective view of the hoisting device and optional sleeve located over a mast pole.
Figure 3:
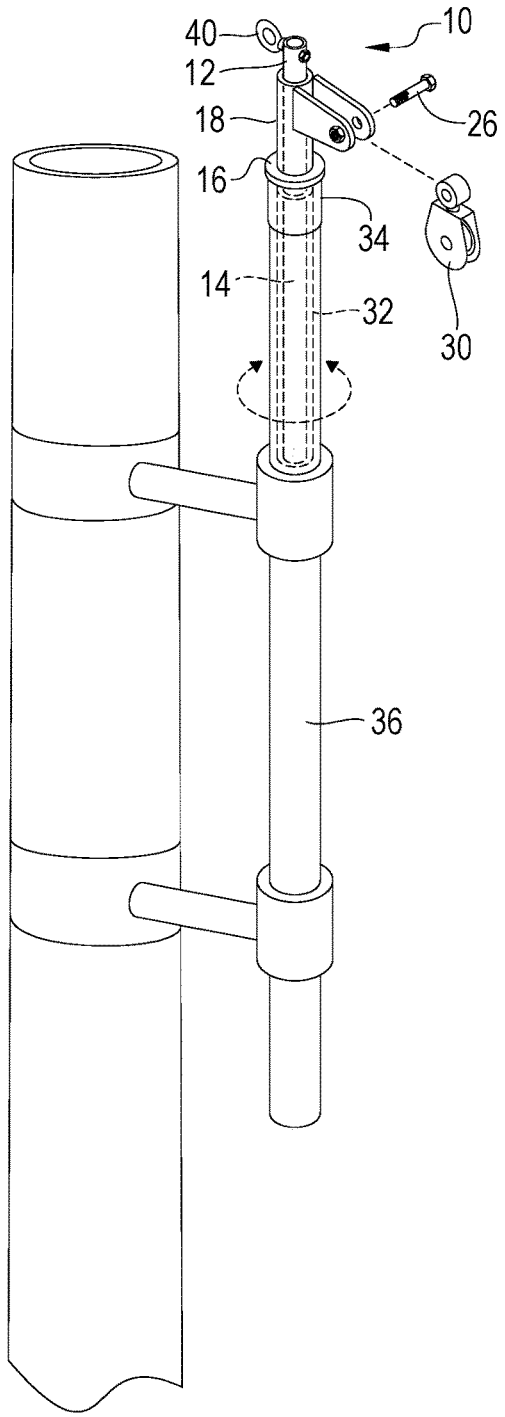
FIG. 3 is a perspective view of the hoisting device installed into the top of a mast pole showing rotation.
Figure 4:
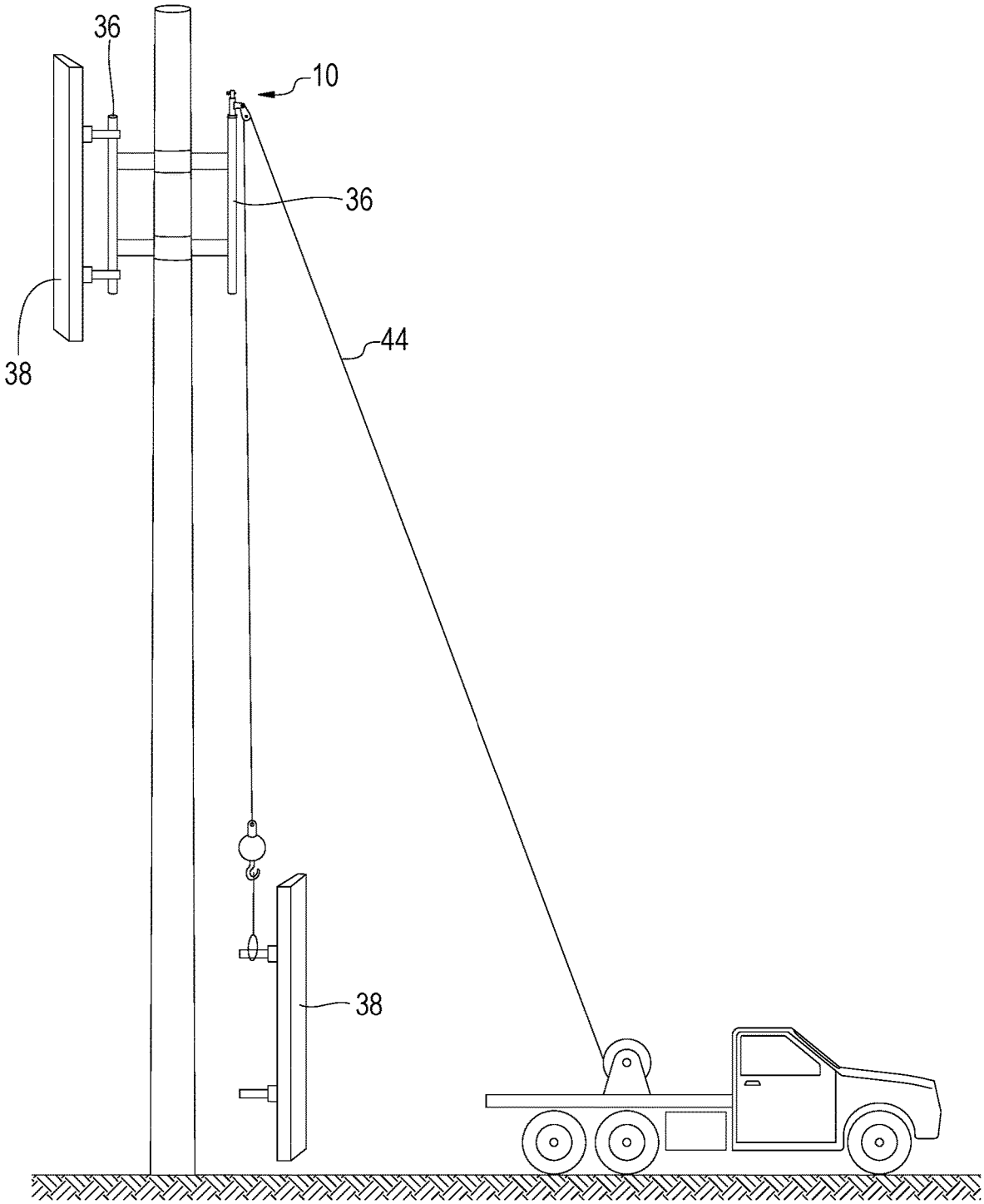
FIG. 4 is a perspective view of the hoisting device in operation as it is used to lift and antenna for installation.
Figure 5:
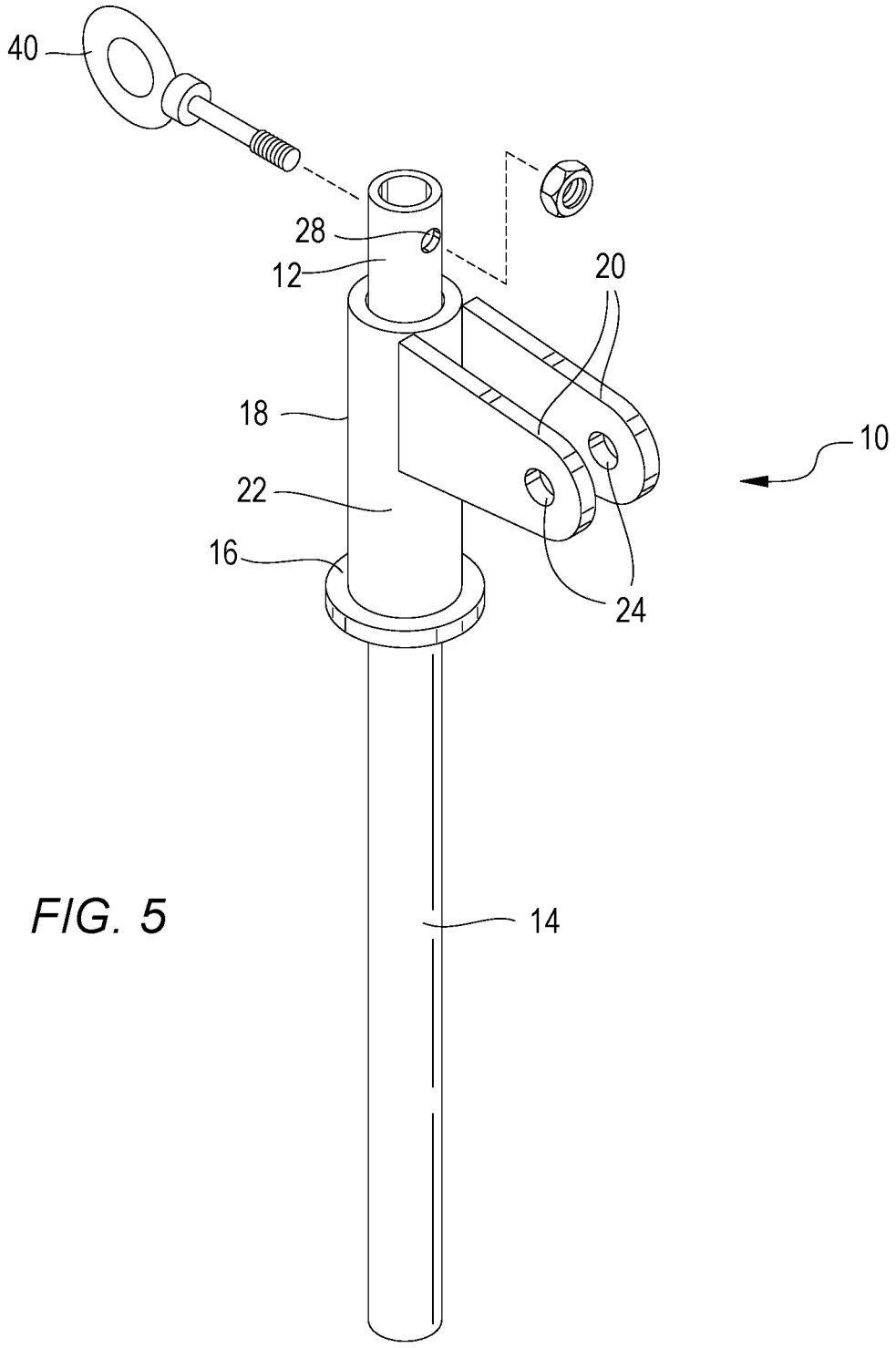
FIG. 5 is a perspective view of the hoisting device.

Referring now to FIG. 1 there is shown an exploded perspective of the rotational hoist device. For sake of brevity the term rotational hoist device may alternatively be referred to as the "hoisting device" and both terms identify the invention. The hoisting device has a hoist pole 10 that has an upper portion 12 and a lower portion 14 with a collar 16 that is located between the upper portion 12 and the lower portion 14. The hoist pole 10 in one embodiment is 3 feet long. The hoisting device is designed to be inserted into a mast pole 36 on a cellular network tower. Mast poles 36, as shown in FIGS. 2-4, are vertical hollow cylindrical poles that are mounted to super structure such as beams on the top of a cell tower. The mast pole 36 serves two purposes. One purpose of a mast pole 36 is to use it as mounting location for antennas 38 and other cellular equipment. A second purpose or function of the mast pole is to use top of the mast pole 36 as hoisting location as it is normally the tallest structure on a cell phone tower and allows for cellular equipment to be lifted to an adequate height for installation on the mast pole 36 or the cellular tower superstructure located at the top of the tower.

The hoisting device also has a head 18 that has a hollow cylindrical body 22 and two vertical parallel plates 20 that project of a side of the head 18. The two vertical parallel plates 20 each have an aperture 24 that corresponds to the aperture 24 on the other vertical parallel plate. The apertures 24 are purposed for installing a third-party block 30 and tackle by locating the block 30 between the vertical parallel plates 20 and inserting a bolt through said apertures 24 and said block 30 with a nut to secure the block to the head 18. The head 18 is inserted on the upper portion 12 of the hoist pole and comes to rest on the collar 16. An eye bolt 40 and nut are then inserted through an aperture 28 located on the top and through the upper portion of the hoist pole. The eye bolt secures the head 18 to the hoist pole 10 such that the head 18 cannot inadvertently be removed or dislodged. In use, the bottom portion 14 of the hoist pole 10 is inserted into the top opening of a hollow mast pole 36 whereby the collar 16 makes contact with the top edge of the mast pole 36 such that the head 18 is not pinned against the eye bolt 40. Mast poles 36 are made of metal as is the hoist device and hoist pole 10. A user would then take a hoist line and insert it into the block 30 and lower a tag end of the hoist line 44 down to the ground for a person to attach the hoist line 44 to a piece of cellular equipment such as antenna 38 as shown in FIG. 4. The remaining tag end of the hoist line 44 is connected to a winch which slowly raises the cellular equipment up alongside the mast pole 36. A cellular network installation technician would locate, for example, an antenna 38 in the appropriate orientation on the mast pole 36 by rotating the head 18 of the hoist device in a desired direction to then place and install the antenna 38 the desired side of the mast pole 36. The rotational ability of the head 18 to rotate on the upper portion 12 of the hoist pole 10 greatly enhances safety of the technician because it allows for the antenna 38 to be attached at all times to the hoist line 44. Traditionally, technicians would have to detach heavy and cumbersome antennas 36 and other equipment from the hoist line 44 and move them and support them by hand to the desired position on a mast pole 36. This is extremely dangerous work and the hoisting device solves this problem such that the cellular equipment is supported by the hoist line 44 until the equipment is bracketed and installed on a mast pole 36.

Further disclosed in FIG. 2 is an optional tubular sleeve 32 having a collar 34 on its top end. Certain mast poles 36 on particular cellular network towers are wider than others which would cause the bottom portion of 14 of the hoist pole to fit sloppily inside the mast pole 36 causing instability of the hoisting device. The tubular sleeve 32 solves this problem by having an inner diameter substantially equivalent to the diameter for the bottom portion 14 hoist pole 10 and the outer diameter of the tubular sleeve 34 is generally equivalent to the inner diameter of the mast pole 36. The tubular sleeve 34 is inserted into the mast pole 36 and the bottom portion 14 of the hoist pole 10 is inserted into the tubular sleeve. The tubular sleeve 34 or sleeves 34 of different diameter allows one standard hoisting device to be used with a variety of widths that a technician may encounter on the top of various mast poles. The collar 34 is designed to be the resting surface for collar 16 on the hoist pole 10 which allows the head 18 to rotate more freely than if the head 18 were pinned against the eye bolt 40. In an alternate embodiment, a plurality of collars can be installed onto the bottom portion 14 of the hoist pole 10 such that the collars fill the extra space between the inner diameter of the mast pole and the outer diameter of the bottom portion 14 of the mast pole 36.

The principles, embodiments, and modes of operation of the present invention have been set forth in the foregoing specification. The embodiments disclosed herein should be interpreted as illustrating the present invention and not as restricting it. The foregoing disclosure is not intended to limit the range of equivalent structure available to a person of ordinary skill in the art in any way, but rather to expand the range of equivalent structures in ways not previously contemplated. Numerous variations and changes can be made to the foregoing illustrative embodiments without departing from the scope and spirit of the present invention.

ELEMENTS

10 hoist pole
12 upper portion
14 lower portion
16 collar
18 head
20 vertical parallel plates
22 hollow cylindrical body
24 apertures
26 bolt
28 aperture
30 block and tackle
32 sleeve
34 sleeve collar
36 mast pole
38 antenna
40 upper gin pole aperture
42 eye bolt
44 Hoist line

What I claim is:

1. A rotational hoisting device, comprising;

a pole having an upper portion and a lower portion whereby the upper portion is separated from the lower portion by a collar;

a head having a hollow cylindrical main body that is adapted to be inserted over and on top of the upper portion of the pole and whereby the lower portion of the pole is insertable into a mast pole located on a cellular tower such that the collar comes to rest on a top edge of the mast pole; and a removable block attachable to the head such that a hoist line can be inserted into the block for hoisting an item of cellular tower equipment to the top of the cellular tower for mounting.

2. The rotational hoisting device of claim 1 wherein the head has two vertical parallel plates located on the side of the hollow cylindrical main body and whereby each said vertical parallel plate has an aperture that corresponds to each other such that the removable block can be installed between the vertical parallel plates by using a bolt and nut to attach the block to the vertical parallel plates of the head.

3. The rotational hoisting device of claim 1 further comprising an aperture in the upper portion of the pole purposed for inserting a bolt to ensure that the head maintains position on the pole.

4. The rotational hoisting device of claim 1 further comprising a tubular sleeve that is purposed for insertion into the mast pole such that the rotational hoisting device can be installed into the tubular sleeve where the mast pole does not conform to the diameter of the hoisting device pole bottom portion.

5. The rotational hoisting device of claim 4 further comprising the collar on top of the tubular sleeve such that the rotational hoisting device collar comes to rest on top of the tubular sleeve collar and the hoisting device can be rotated from side to side.

6. A method for hoisting and mounting a cellular component onto the top of a cellular comprising the steps of:

providing a rotational hoist device further comprising a pole having an upper portion and a lower portion whereby the upper portion is separated from the lower portion by a collar;

a head having a hollow cylindrical main body that is adapted to be inserted over and on top of the upper portion of the pole and whereby the lower portion of the pole is insertable into a mast pole located on a cellular tower such that the collar comes to rest on the top edge of the mast pole; and a removable block attachable to the head such that a hoist line can be inserted into the block for hoisting an item of a cellular tower equipment to the top of the cellular tower for mounting;

installing a block between two vertical parallel plates located and installing a hoist line into the block and dropping said hoist line down to the ground for attachment to a piece of cellular equipment;

installing said rotational hoist device into the top of a mast pole located at the top of the cellular tower;

connecting the tag end of the hoist line to a winch and winching the piece or equipment upwards to the top of the cellular tower;

hoisting the equipment to an appropriate level adjacent to the mast pole;

rotating the rotational hoist device around the mast pole to a desired position; and mounting the cellular equipment to a desired position on the mast pole.

7. The method of claim 6 further comprising the steps of inserting a tubular sleeve into the mast pole whereby said tubular sleeve has a collar on its top end when the diameter of a given mast pole is to large for the rotational hoist device and then installing the rotational hoist device into the tubular sleeve such that there is a substantially flush fit of the rotational hoist device inside the mast pole.

* * * * *